United States Patent [19]

Troy

[11] 3,993,220

[45] Nov. 23, 1976

[54] FLEXIBLE CONTAINER OPENER AND DISPENSER

[76] Inventor: William A. Troy, 322 Mohawk, Park Forest, Ill. 60466

[22] Filed: Aug. 1, 1975

[21] Appl. No.: 600,939

[52] U.S. Cl. ..... 222/82; 222/88; 222/95; 222/105; 222/323

[51] Int. Cl.[2] ..... B65D 35/28

[58] Field of Search ..... 222/82, 81, 88, 95, 222/101, 103, 105, 323

[56] References Cited

UNITED STATES PATENTS

| | | | |
|---|---|---|---|
| 2,833,444 | 5/1958 | Sherbondy | 222/105 X |
| 2,903,161 | 9/1959 | Stahmer | 222/103 X |
| 3,120,905 | 2/1964 | Smith | 222/103 |
| 3,199,736 | 8/1965 | Smith | 222/105 X |
| 3,395,822 | 8/1968 | Donleavy | 222/105 X |

*Primary Examiner*—Allen N. Knowles
*Assistant Examiner*—Norman L. Stack, Jr.
*Attorney, Agent, or Firm*—Raymond M. Mehler

[57] ABSTRACT

A device is provided for opening a flexible container and dispensing its contents in a convenient, efficient manner. Gripping means secure one end of the container. A serrated edge lies along the opposite end of the container. A scraper is mounted along the device and is slidable between the gripping means and the serrated edge. The device is especially suitable for use with plastic pouches in which foods are marketed.

9 Claims, 4 Drawing Figures

FLEXIBLE CONTAINER OPENER AND DISPENSER

My invention is an apparatus for opening flexible containers and for dispensing the contents thereof.

A variety of items are marketed today in flexible containers. Many of these items are foods or other perishable products. They may be either frozen or processed for shelf stability at room temperatures. Such shelf-stability processing can be by pasteurization, sterilization, chemical preservation, freeze drying, retorting, or the like. Often it is necessary for the user to further process the item while it remains sealed in its container. The most common type of further processing is heating, either by immersing in boiling water or by placing in an oven, such as those of the hot air, microwave or infrared type. When heating is required, it is generally also intended that the item be removed from its container while it is still hot.

It is desirable to provide a means that will conveniently, safely and efficiently open these flexible containers, even when they are still very hot. Further advantages can be gained if that same means also performs the function of removing the item from the container once it has been opened, especially for items that include liquid or very fine solid material which tends to remain within the heated container and not be readily removed therefrom by gravity alone. Such liquid or fine solid material tends to adhere to the inside walls of the container and must be scraped therefrom by a spatula or similar implement.

This internal scraping is difficult, since it is a tedious task to attempt to manipulate any rigid or semi-rigid implement within the confined space of a container which does not provide a firm support for such manipulation, but is instead somewhat amorphous in nature. This task can also be unsanitary because of the need to insert such implements or portions of the hands into the container. These difficulties are compounded when the flexible container and its contents are literally too hot to touch without incurring serious discomfort or even minor burns, thereby preventing the user from scraping out the contents by squeezing the interior of the container.

It is accordingly an object of this invention to provide an improved apparatus that safely and conveniently opens a flexible container and efficiently, sanitarily and safely dispenses the contents thereof.

Another object of the invention is an improved apparatus that will open and dispense items from a flexible container while the items and the container are heated well above room temperatures.

One other object of this improved apparatus is to provide a convenient and firm means for holding and gripping a flexible container while it is opened and its contents are dispensed in a safe and sanitary manner.

The present apparatus includes a body member, a gripping arm pivotally mounted at one end thereof, a serrated edge at the other end thereof, and a scraping member mounted on said body for slidable movement therealong from said one end to said other end.

Other objects, features and advantages of this invention, if not specifically set out herein, will be apparent to those skilled in the art from the following description and drawings, in which.

Figure 1:
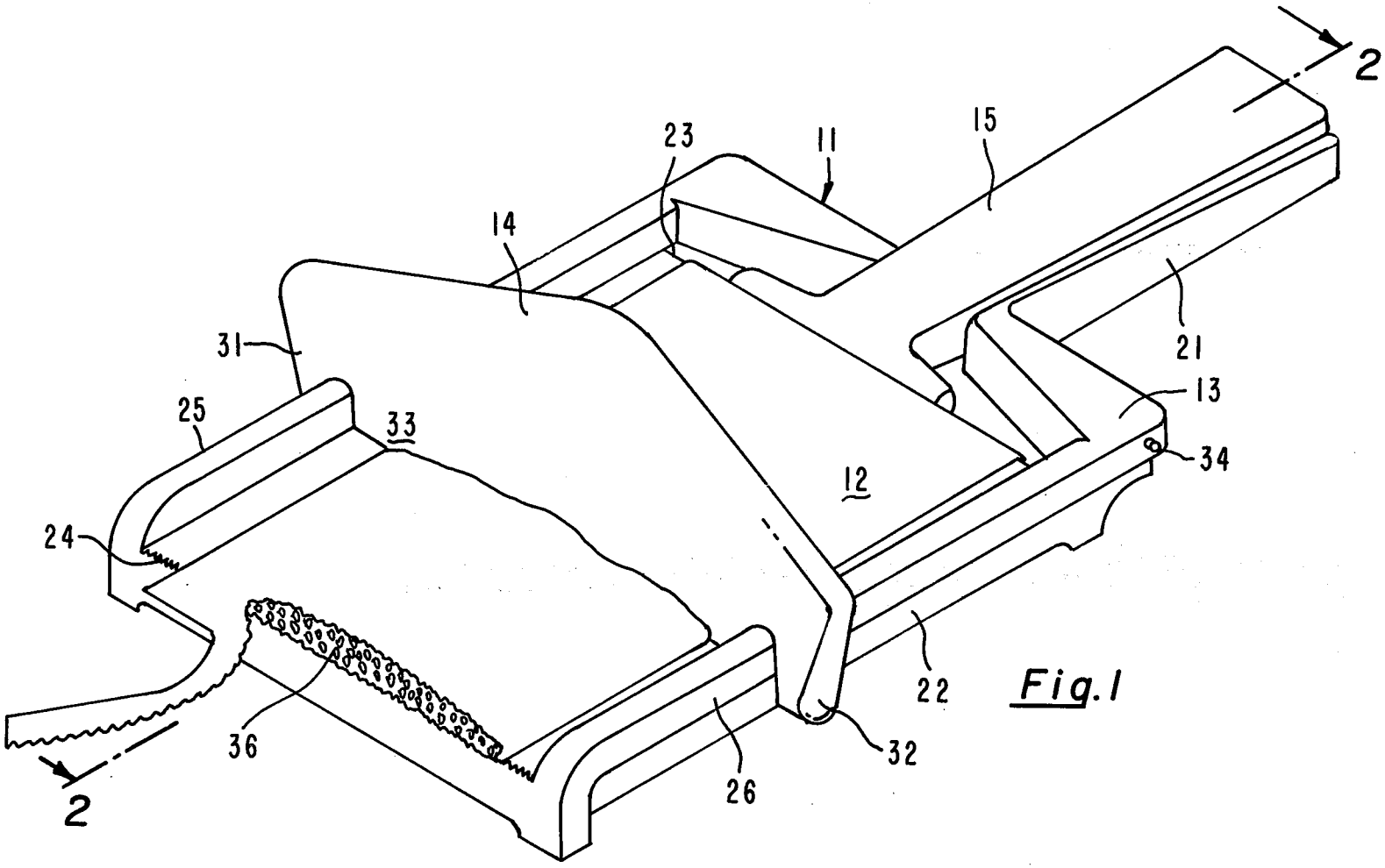
FIG. 1 is a perspective view of the preferred embodiment of the invention.

The preferred device, generally indicated by reference numeral 11, is shown in FIG. 1 along with a partially opened container 12, such as a flexible plastic. It is to be understood that this container need not be a flexible plastic pouch of the type depicted. It may be a vacuum formed and packaged pouch or receptacle with or without a semi-rigid backing. It may be a bag that has been blow molded or thermally formed. It may be a container that includes two or more separate compartments.

Device 11 includes body member 13, a scraping member 14, and a pivotable gripping arm 15. Member 13 has a handle 21 protruding from one end thereof. A platform 22 is included in body member 13. Along the transverse end of platform 22 that is nearest to handle 21, there is provided a lip 23. A cutting edge 24 is located along the opposite transverse end of platform 22. Lying along one longitudinal edge of body member 13 is a channel guide 25, while another channel guide 26 lies along the other longitudinal edge.

Scraping member 14 includes ears 31, 32 at opposite ends thereof. Each 31 is structured to slidably engage channel guide 25, while ear 32 is similarly structured with respect to channel guide 26. Guides 25, 26 and ears 31, 32 are in cooperative engagement so as to allow the scraping member 14 to be slid along the surface of platform 22, ears 31, 32 having enough excess depth to permit the interposition of container 12 between member 14 and the surface of platform 22. Scraping member 14 has a generally convex leading surface 33 to assist in providing a smooth scraping function along container 12. Preferably the excess depth of ears 31, 32 is adequate to permit the convex leading surface 33 to be rolled down into engagement with platform 22 or a container 12 lying thereon. This arrangement also enables the scraping member 14 to be slid over the entire top surface of container 12, beginning at its engagement with the top edge of lip 23 and running to just beyond the serrated edge 24. This permits scraping to effect removal from the entire volume of container 12.

Pivotable gripping arm 15 lies generally along handle 21 and is held in its pivotable location by means of axle 34. As can be best seen in FIG. 2, arm 15 pivots between two extreme positions, one a fully open position, and the other its gripping position. In this latter position, a portion of arm 15 engages lip 23, and, when the device 11 is in us, container 12 is gripping therebetween. When arm 15 is in this gripping position, it is preferred that its upper surface be slightly raised with respect to the upper edges of handle 21, so as to afford easy maintenance of the gripping position while the device 11 is held by handle 21.

In the operation of this preferred embodiment, the operator holds device 11 in one hand, preferably gripping the handle 21 with arm 15 resting on the gripping hand of the operator, so that the back of his hand maintains the arm 15 in its open position. Optionally, this maintenance of the open position is achieved by a spring 35, or other suitable means. Additionally, scraping member 14 is slid to the handle end of device 11 and preferably rests on arm 15 so as to provide free access to lip 23. A container 12 is then grasped by the other hand of the operator, and one end of container 12 is inserted so as to engage lip 23. Then arm 15 is allowed to pivot toward is gripping position by removing the operator's hand from thereunder, or spring 35, if provided, is compressed to effect the gripping position. The operator then uses this hand to simultaneously grip the arm 15 and handle 21 to thereby maintain the gripping position and securely hold said one end of container 12, which has by now been released by the other hand. The operator then opens the opposite, free end of the container by pulling it down over cutting edge 24.

The container 12 is thus opened, and its contents 36 can be emptied into a desired container. A thorough dispensing of the contents 36 is accomplished by sliding scraping member 14 along the length of the pouch to thereby squeeze together the opposing faces of pouch 12 to forceably dispense contents 36 therefrom.

Figure 2:
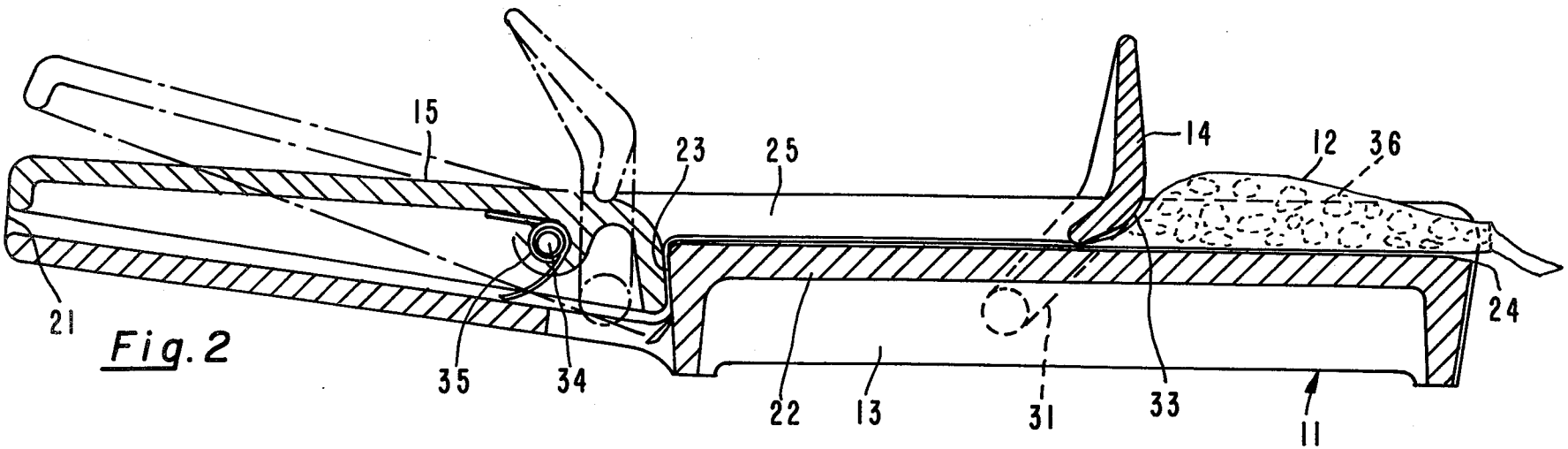
FIG. 2 is a cross-sectional view taken along the line 2—2 of FIG. 1.

The embodiment of FIGS. 1 and 2 preferably has a platform 22 of a width adequate to accommodate the widest of pouches. Of course, such a width will also accommodate the narrowest of pouches. The embodiment shown in FIGS. 3 and 4 has the further advantage of being able to accommodate pouches of varying lengths.

Figure 4:
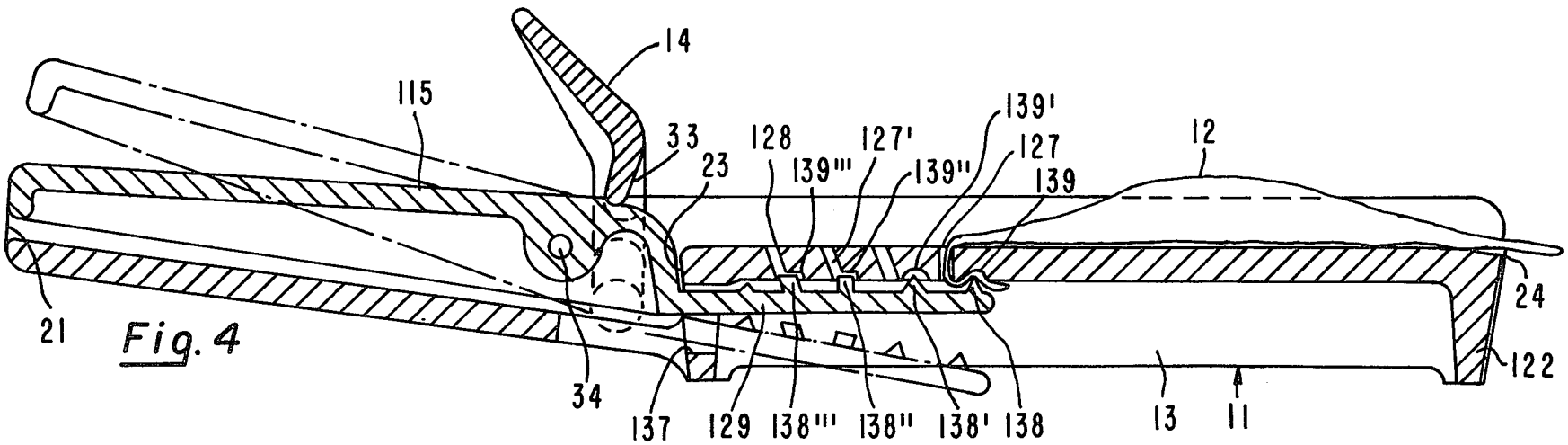
FIG. 4 is a cross-sectional view taken along the line 4—4 of FIG. 3.
Figure 3:
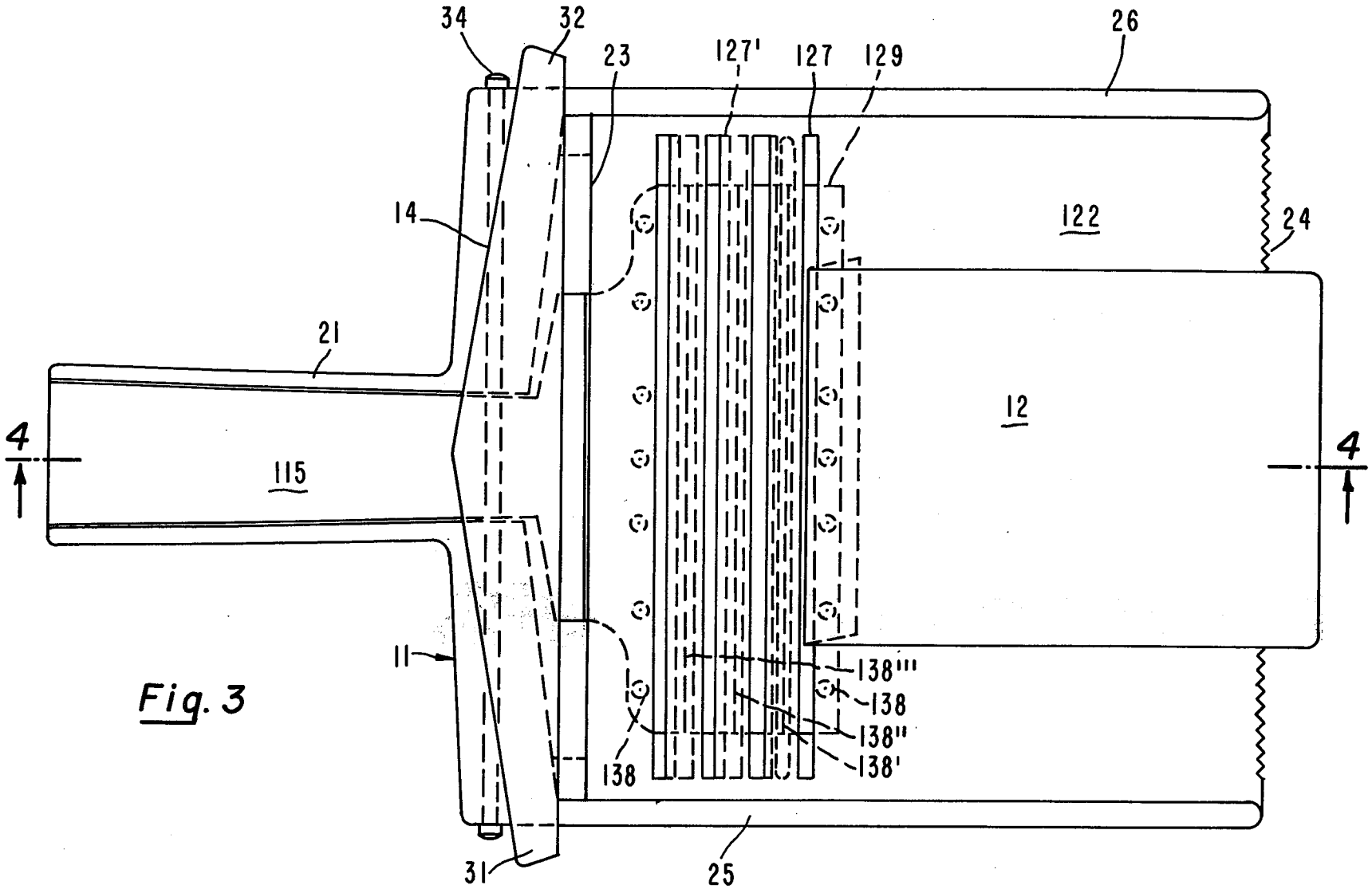
FIG. 3 is a plan view of an alternate embodiment of the invention.

Referring to FIGS. 3 and 4, platform 122 includes one or more transverse slots 127, large enough to permit easy passage of an end of a container 12 therethrough. It is preferred that these slots be positioned non-perpendicularly within said platform so that they are slanted slots 127'. Preferred slots 127' provide for improved container gripping arrangements by virtue of the acute angle formed at slot edge 128. Gripping arm 115 is similar to arm 15 and additionally includes an extension plate 129 lying under at least a portion of platform 122. The gripping position for gripping arm 115 obtains in much the same fashion as the like position of arm 15, except that additional gripping engagements can occur between platform 122 and plate 129. To facilitate the pivotal operation of arm 115, platform 122 includes a slot 136.

Preferably, such gripping engagements, when utilized to secure an end of container 12, are assisted by an engaging means which may assume a variety of structures, including raised serations, teeth and cavities, or bars and channels which engage the container 12. A variety of alternate structures are shown. Those shown are conical teeth 138, with or without complementary cavities 139 in platform 122; an elongated ridge 138' of triangular cross-section, with a complementary elongate bore 139' in platform 122; a bar 138'' protruding at right angles from plate 129, with a complementary channel 139'' in platform 122; and the preferred bar 138''' protruding at an angle approximating that associated with preferred slots 127', with the preferred channel 139''' having roughly the same angle.

The operation of this alternate embodiment is much the same as that of the preferred embodiment, except for the option of being able to, in effect, adjust the length of platform 122 by selecting either lip 23 or one of slots 127, 127' as the gripping location for one end of the container 12. The selection having been made, the container end is inserted, and the arm 115 is lowered into its gripping position, the other end of the container is removed by cutting edge 24, and the contents are dispensed, if desired with the assistance of scraping member 14.

Obviously, many modifications and variations of the invention as hereinbefore set forth may be made without departing from the spirit and scoope thereof, and only such limitations should be imposed as are indicated in the appended claims.

I claim:

1. An opener and dispenser for flexible containers, comprising:

a body member, said body member having a platform;

a handle projecting from one end of said body member;

a cutting edge along an opposite end of said body member;

a gripping arm pivotally mounted on said body member for gripping one end of a flexible container, said gripping arm having a transverse edge;

said platform includes a transverse lip at its end opposite the cutting edge, said lip being structured for cooperative gripping engagement with said transverse edge of the gripping arm when the end of said gripping arm opposite said transverse edge is pivotally depressed toward said handle; and a scraping member mounted on said body member for longitudinal sliding along said body member and over a flexible container.

2. The opener and dispenser as claimed in claim 1, wherein said body member has a channel guide along each longitudinal edge thereof, and said scraping member has an ear on each opposite end thereof structured for cooperative, sliding engagement with each of said channel guides.

3. The opener and dispenser as claimed in claim 2, wherein said scraping member has a convex leading surface and said ears have excess depth with respect to said sliding engagement of the rails to permit the interposition of a flexible container between the body and the sliding member and to permit the convex leading surface to be rolled down into engagement with a flexible container on said body member.

4. The opener and dispenser as claimed in claim 1, wherein said gripping arm lies over said handle, and said gripping arm has a gripping position such that its upper surface is raised with respect to the upper edges of said handle.

5. The opener and dispenser as claimed in claim 1, wherein said cutting edge is located on the end of said platform opposite said lip.--

6. An opener and dispenser for flexible containers, comprising:

a body member, said body member including a platform, said platform having a transverse slot, a handle projecting from one end of said body member, a cutting edge along an opposite end of said body member, a gripping arm pivotally mounted on said body member for gripping one end of a flexible container, said gripping arm including an extension plate lying under said platform and slot and being in cooperative gripping engagement with said platform, and a scraping member mounted on said body member for longitudinal sliding along said body member and over a flexible container.--

7. The opener and dispenser as claimed in claim 6, wherein said extension plate includes an engaging means positioned between the extension plate and said platform.

8. The opener and dispenser as claimed in claim 7, wherein said engaging means includes a projection from said extension plate and an indentation that is substantially complementary with said projection.

9. The opener and dispenser as claimed in claim 6, wherein said platform includes a lip at one end thereof, said lip is in cooperative engagement with said gripping arm, and said cutting edge is located on an opposite end of said platform.

* * * * *